US010183851B2

(12) United States Patent
Kato et al.

(10) Patent No.: US 10,183,851 B2
(45) Date of Patent: Jan. 22, 2019

(54) CARGO VEHICLE

(71) Applicant: KABUSHIKI KAISHA TOYOTA JIDOSHOKKI, Kariya-shi, Aichi (JP)

(72) Inventors: Norihiko Kato, Kariya (JP); Yukikazu Koide, Kariya (JP)

(73) Assignee: KABUSHIKI KAISHA TOYOTA JIDOSHOKKI, Kariya-shi, Aichi (JP)

( * ) Notice: Subject to any disclaimer, the term of this patent is extended or adjusted under 35 U.S.C. 154(b) by 0 days.

(21) Appl. No.: 15/455,924

(22) Filed: Mar. 10, 2017

(65) Prior Publication Data

US 2017/0260033 A1 Sep. 14, 2017

(30) Foreign Application Priority Data

Mar. 11, 2016 (JP) ..... 2016-048408

(51) Int. Cl.
*B66F 9/22* (2006.01)
*E02F 9/22* (2006.01)
(Continued)

(52) U.S. Cl.
CPC ..... *B66F 9/22* (2013.01); *E02F 9/2203* (2013.01); *E02F 9/2246* (2013.01); *F15B 11/08* (2013.01);
(Continued)

(58) Field of Classification Search
CPC ..... B66F 9/22; E02F 9/2246; F15B 19/00; F15B 13/044; F15B 11/08;
(Continued)

(56) References Cited

U.S. PATENT DOCUMENTS 4,741,516 A * 5/1988 Davis
5,542,405 A * 8/1996 Gerhardy
(Continued)

FOREIGN PATENT DOCUMENTS

CN 102917972 A 2/2013
EP 2 803 619 A1 11/2014
(Continued)

OTHER PUBLICATIONS

Communication dated Aug. 25, 2017 from the European Patent Office in counterpart Application No. 17160289.9.

*Primary Examiner* — Frederick M Brushaber
(74) *Attorney, Agent, or Firm* — Sughrue Mion, PLLC

(57) ABSTRACT

A cargo vehicle includes a hydraulic pump driven by an engine, a cargo handling apparatus operated by hydraulic oil from the hydraulic pump, a cargo operating unit for performing an instruction operation to operate the cargo handling apparatus, an electromagnetic proportional control valve disposed between the hydraulic pump and the cargo handling apparatus, a valve controller that controls the electromagnetic proportional control valve depending on an operation state of the cargo operating unit, and a revolution detector that detects a revolution of the engine, wherein the valve controller controls the electromagnetic proportional control valve such that an opening degree of the electromagnetic proportional control valve is limited for a certain time when the revolution of the engine detected by the revolution detector is lower than a predetermined value.

4 Claims, 6 Drawing Sheets

(51) Int. Cl.
*F15B 19/00* (2006.01)
*F15B 13/044* (2006.01)
*F15B 11/08* (2006.01)

(52) U.S. Cl.
CPC ..... *F15B 13/044* (2013.01); *F15B 19/00* (2013.01); *F15B 2211/20523* (2013.01); *F15B 2211/633* (2013.01); *F15B 2211/7051* (2013.01)

(58) Field of Classification Search
CPC ..... F15B 2211/7051; F15B 2211/633; F15B 2211/20523
See application file for complete search history.

(56) References Cited

U.S. PATENT DOCUMENTS 7,757,486 B2 * 7/2010 Ichimura
9,145,657 B2 * 9/2015 Lee
2011/0253102 A1 * 10/2011 Watanabe
2013/0055704 A1 3/2013 Heo et al.
2013/0167521 A1 7/2013 Tsuruta et al.
2013/0282187 A1 * 10/2013 Bang
2014/0331659 A1 11/2014 Kato et al.
2014/0369866 A1 * 12/2014 Ueda
2015/0274497 A1 10/2015 Kato et al.
2016/0332854 A1 * 11/2016 Ueda
2016/0362034 A1 * 12/2016 Fushiki

FOREIGN PATENT DOCUMENTS

JP 54-91687 A 7/1979
JP 10-101299 A 4/1998
JP 11-209095 A 8/1999
JP 11-301 993 A 11/1999
JP 2010-76937 A 4/2010
JP 2012-62137 A 3/2012
JP 2014-222079 A 11/2014
JP 2015-187026 A 10/2015

* cited by examiner

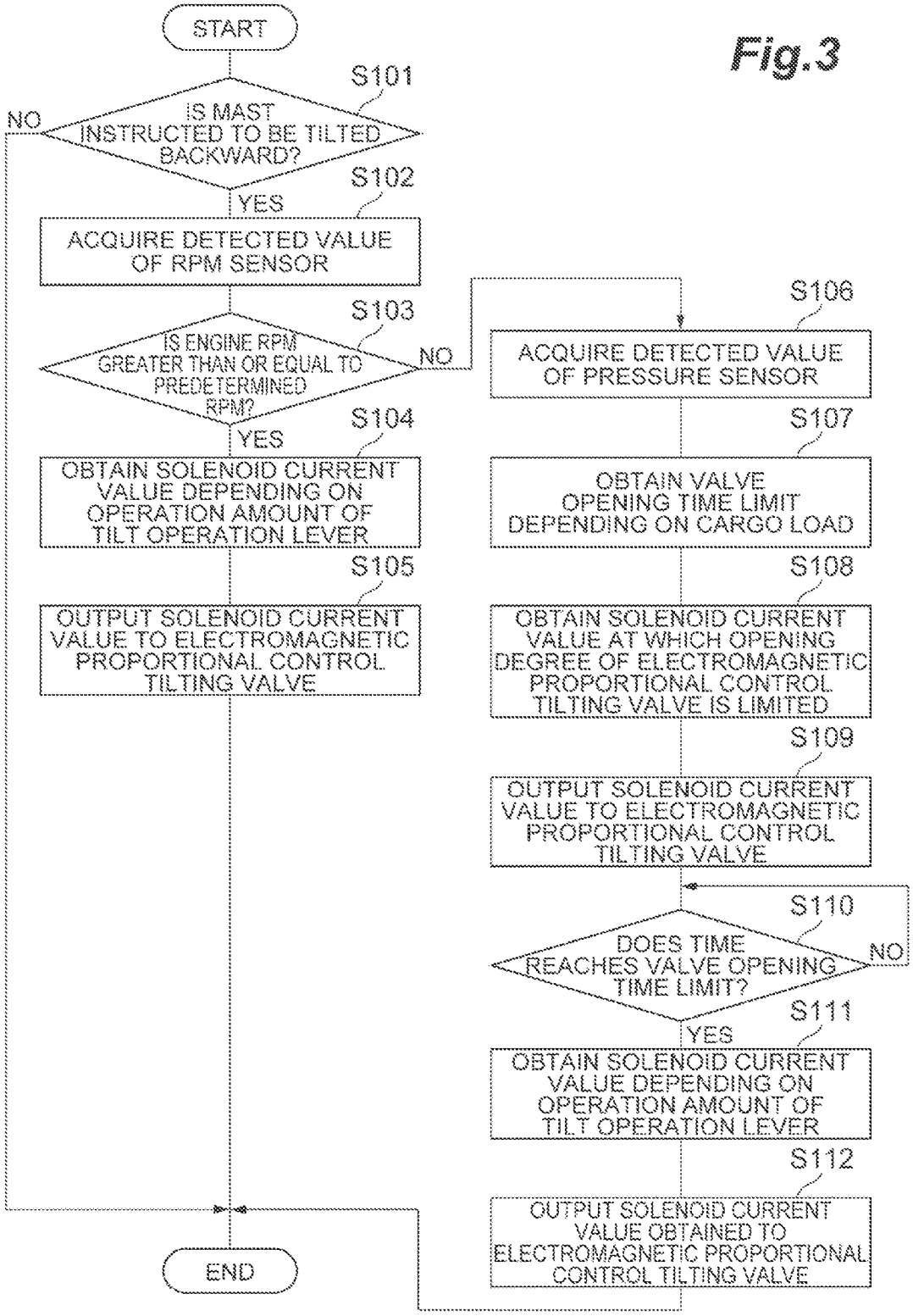
Fig.3
START
S101
IS MAST INSTRUCTED TO BE TILTED BACKWARD?
NO
YES
S102
ACQUIRE DETECTED VALUE OF RPM SENSOR
S103
IS ENGINE RPM GREATER THAN OR EQUAL TO PREDETERMINED RPM?
NO
YES
S104
OBTAIN SOLENOID CURRENT VALUE DEPENDING ON OPERATION AMOUNT OF TILT OPERATION LEVER
S105
OUTPUT SOLENOID CURRENT VALUE TO ELECTROMAGNETIC PROPORTIONAL CONTROL TILTING VALVE
S106
ACQUIRE DETECTED VALUE OF PRESSURE SENSOR
S107
OBTAIN VALVE OPENING TIME LIMIT DEPENDING ON CARGO LOAD
S108
OBTAIN SOLENOID CURRENT VALUE AT WHICH OPENING DEGREE OF ELECTROMAGNETIC PROPORTIONAL CONTROL TILTING VALVE IS LIMITED
S109
OUTPUT SOLENOID CURRENT VALUE TO ELECTROMAGNETIC PROPORTIONAL CONTROL TILTING VALVE
S110
DOES TIME REACHES VALVE OPENING TIME LIMIT?
NO
YES
S111
OBTAIN SOLENOID CURRENT VALUE DEPENDING ON OPERATION AMOUNT OF TILT OPERATION LEVER
S112
OUTPUT SOLENOID CURRENT VALUE OBTAINED TO ELECTROMAGNETIC PROPORTIONAL CONTROL TILTING VALVE
END

CARGO VEHICLE

TECHNICAL FIELD

The present invention relates to a cargo vehicle.

BACKGROUND

For example, a forklift described in Japanese Unexamined Patent Publication No. 2012-62137 is known as a cargo vehicle. The cargo vehicle described in Japanese Unexamined Patent Publication No. 2012-62137 includes a cargo handling hydraulic actuation device, a cargo handling pump driven by an engine, a cargo handling hydraulic pipe that connects the cargo handling pump to the cargo handling hydraulic actuation device, a discharge pipe which branches from the cargo handling hydraulic pipe and is connected to a tank, a ON/OFF valve provided in the discharge pipe, a controller that controls the ON/OFF valve such that the discharge pipe is closed when a revolution of the engine is larger than a preset value, and the discharge pipe is open when the revolution of the engine is less than or equal to the preset value, and a sub-relief valve provided at a downstream side of the ON/OFF valve in the discharge pipe. The sub-relief valve closes the discharge pipe when a pressure of hydraulic oil flowing through the discharge pipe is smaller than a relief pressure, and the sub-relief valve opens the discharge pipe when the pressure of hydraulic oil flowing through the discharge pipe reaches the relief pressure.

SUMMARY

However, in a cargo vehicle as in the above-described conventional art, a phenomenon may occur in which a cargo handling operation is temporarily suspended when a hydraulic pressure load between the cargo handling pump and the cargo handling hydraulic actuation device rises.

An object of the invention is to provide a cargo vehicle capable of preventing temporary suspension of a cargo handling operation.

A cargo vehicle of an aspect of the invention includes a hydraulic pump driven by an engine, a cargo handling apparatus operated by hydraulic oil from the hydraulic pump, a cargo operating unit for performing an instruction operation to operate the cargo handling apparatus, an electromagnetic proportional control valve disposed between the hydraulic pump and the cargo handling apparatus, a valve controller that controls the electromagnetic proportional control valve depending on an operation state of the cargo operating unit, and a revolution detector that detects a revolution of the engine, wherein the valve controller controls the electromagnetic proportional control valve such that an opening degree of the electromagnetic proportional control valve is limited for a certain time when the revolution of the engine detected by the revolution detector is lower than a predetermined value.

In such a cargo vehicle, when the instruction operation is performed by the cargo operating unit to operate the cargo handling apparatus, hydraulic oil is supplied from the hydraulic pump to the cargo handling apparatus by controlling the electromagnetic proportional control valve depending on the operation state of the cargo operating unit using the valve controller, and the cargo handling apparatus is operated. In this instance, a sharp rise in the hydraulic pressure load between the hydraulic pump and the cargo handling apparatus is suppressed by controlling the electromagnetic proportional control valve such that the opening degree of the electromagnetic proportional control valve is limited for the certain time when the revolution of the engine is lower than the predetermined value. In this way, it is possible to prevent temporary suspension of a cargo handling operation.

The cargo vehicle may further include a cargo load detector that detects a cargo load of the cargo handling apparatus, and a time setting unit that sets a period of time during which the opening degree of the electromagnetic proportional control valve is limited depending on the cargo load of the cargo handling apparatus detected by the cargo load detector, wherein the valve controller controls the electromagnetic proportional control valve such that the opening degree of the electromagnetic proportional control valve is limited during the time period set by the time setting unit when the revolution of the engine is lower than the predetermined value. As the cargo load of the cargo handling apparatus increases, the hydraulic pressure load between the hydraulic pump and the cargo handling apparatus increases. Therefore, responsiveness of the cargo handling apparatus with respect to the instruction operation of the cargo operating unit may be ensured when the cargo load of the cargo handling apparatus is light, and temporary suspension of the cargo handling operation may be prevented, and a load may be smoothly moved when the cargo load of the cargo handling apparatus is heavy by setting the time period during which the opening degree of the electromagnetic proportional control valve is limited depending on the cargo load of the cargo handling apparatus.

The time setting unit may set the time period in phases depending on the cargo load of the cargo handling apparatus. In this case, it is possible to easily set the time period while absorbing a variation in a detected value of the cargo load detector.

The cargo handling apparatus may have a tilt cylinder that tilts a mast forward or backward, the cargo operating unit may be a tilt operation unit for performing an instruction operation to operate the tilt cylinder, the electromagnetic proportional control valve may be disposed between the hydraulic pump and the tilt cylinder, and the valve controller may control the electromagnetic proportional control valve such that the opening degree of the electromagnetic proportional control valve is limited for a certain time when the revolution of the engine is lower than the predetermined value at a time of performing an instruction operation by the tilt operation unit to tilt the mast backward. In this case, it is possible to prevent temporary suspension of an operation of tilting the mast backward.

According to the invention, it is possible to provide a cargo vehicle capable of preventing temporary suspension of a cargo handling operation.

BRIEF DESCRIPTION OF THE DRAWINGS

FIG. 3 is a flowchart illustrating details of a procedure executed by a main controller when a mast is tilted backward by a tilt cylinder;

DETAILED DESCRIPTION

Hereinafter, an embodiment of the invention will be described in detail with reference to drawings.

Figure 1:
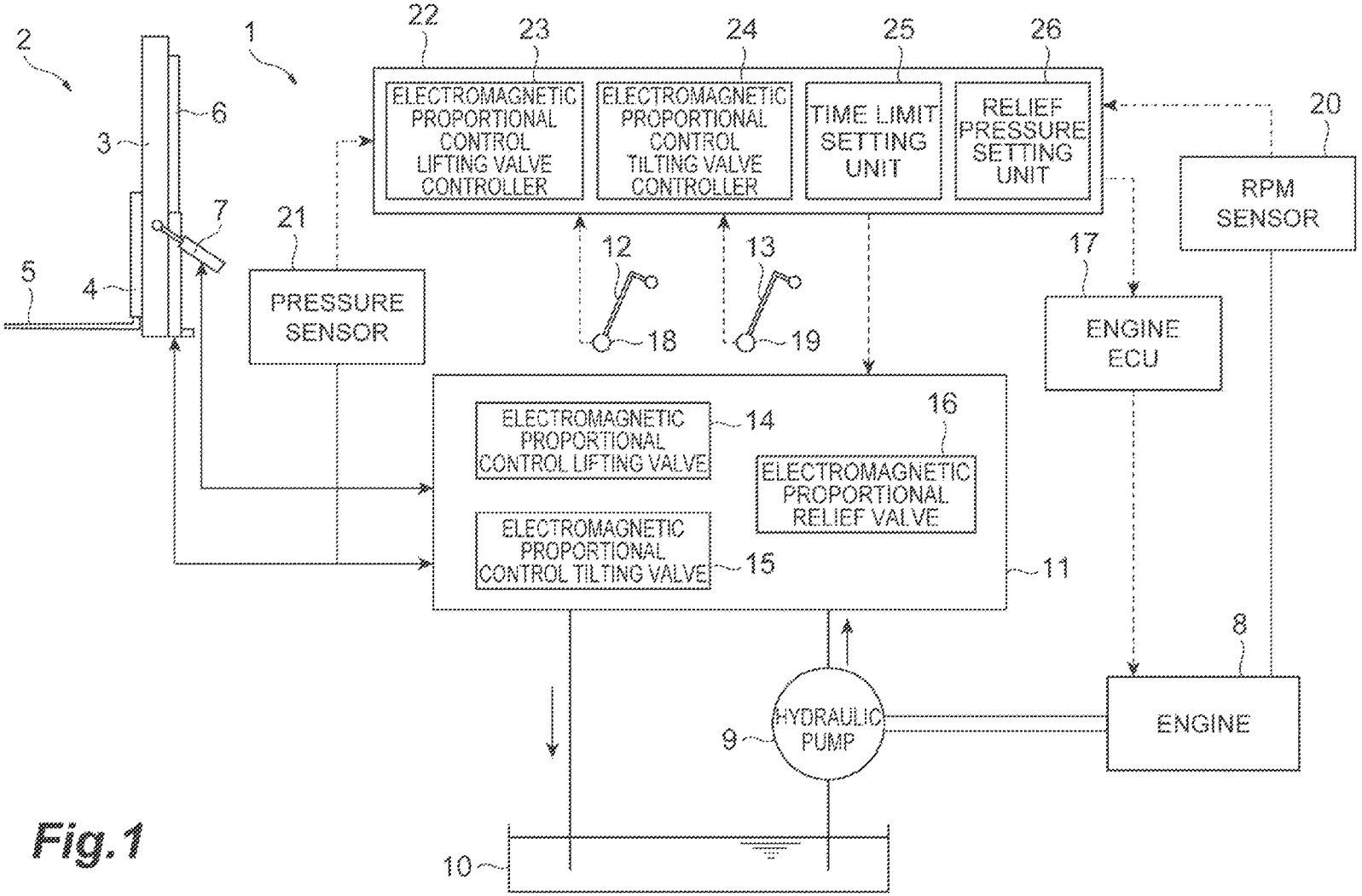
FIG. 1 is a schematic block diagram illustrating an engine-type forklift as an embodiment of a cargo vehicle according to the invention.

FIG. 1 is a diagram illustrating a schematic configuration of an engine-type forklift as an embodiment of a cargo vehicle according to the invention. In FIG. 1, a forklift 1 corresponding to a cargo handling apparatus of the present embodiment includes a cargo handling apparatus 2. The cargo handling apparatus 2 includes a mast 3, a fork 5 attached to the mast 3 through a lift bracket 4 and loaded with a load, a lift cylinder 6 that lifts and lowers the fork 5, and a tilt cylinder 7 that tilts the mast 3 forward or backward.

In addition, the forklift 1 includes an engine 8 serving as a driving source of a driving operation and a cargo handling operation, a hydraulic pump 9 driven by the engine 8 to discharge hydraulic oil, a tank 10 that accumulates hydraulic oil, a control valve 11 disposed between the hydraulic pump 9 and the cargo handling apparatus 2, a lift operation lever 12 for performing an instruction operation to operate the lift cylinder 6, and a tilt operation lever 13 (tilt operation unit) for performing an instruction operation to operate the tilt cylinder 7. The lift operation lever 12 and the tilt operation lever 13 are included in a cargo operating unit for performing an instruction operation to operate the cargo handling apparatus 2.

The control valve 11 includes an electromagnetic proportional control lifting valve 14, an electromagnetic proportional control tilting valve 15, and an electromagnetic proportional relief valve 16. The electromagnetic proportional control lifting valve 14 is a valve disposed between the hydraulic pump 9 and the lift cylinder 6 to control a flow rate of hydraulic oil supplied from the hydraulic pump 9 to the lift cylinder 6 by being opened in proportion to a solenoid current value output from an electromagnetic proportional control lifting valve controller 23 (described below).

The electromagnetic proportional control tilting valve 15 is a valve disposed between the hydraulic pump 9 and the tilt cylinder 7 to control a flow rate of hydraulic oil supplied from the hydraulic pump 9 to the tilt cylinder 7 by being opened in proportion to a solenoid current value output from an electromagnetic proportional control tilting valve controller 24 (described below).

The electromagnetic proportional relief valve 16 is a valve that discharges hydraulic oil to the tank 10 when a pressure of hydraulic oil flowing between the hydraulic pump 9 and the cargo handling apparatus 2 reaches a relief pressure set by a relief pressure setting unit 26 (described below).

In addition, the forklift 1 includes an engine electronic control unit (ECU) 17 that controls the engine 8, a lift operation detection sensor 18 that detects an operation state (operation direction and operation amount) of the lift operation lever 12, a tilt operation detection sensor 19 that detects an operation state (operation direction and operation amount) of the tilt operation lever 13, an RPM sensor 20 (revolution detector) that detects an RPM (revolutions per minute) of the engine 8, a pressure sensor 21 (cargo load detector) that detects a pressure between the lift cylinder 6 and the electromagnetic proportional control lifting valve 14 as a cargo load of the cargo handling apparatus 2, and a main controller 22.

The main controller 22 inputs detected values of the lift operation detection sensor 18, the tilt operation detection sensor 19, the RPM sensor 20, the pressure sensor 21, etc. to perform a predetermined process, thereby controlling the control valve 11 and the engine ECU 17.

The main controller 22 includes the electromagnetic proportional control lifting valve controller 23, the electromagnetic proportional control tilting valve controller 24, a time setting unit 25, and the relief pressure setting unit 26.

The electromagnetic proportional control lifting valve controller 23 controls the electromagnetic proportional control lifting valve 14 according to the operation state of the lift operation lever 12 detected by the lift operation detection sensor 18. Specifically, the electromagnetic proportional control lifting valve controller 23 outputs a solenoid current value according to the operation amount of the lift operation lever 12 to the electromagnetic proportional control lifting valve 14.

Then, the fork 5 is raised and lowered. Specifically, when the fork 5 is instructed to be raised by the lift operation lever 12, hydraulic oil is pumped up from the tank 10 by the hydraulic pump 9, and the hydraulic oil is supplied to the lift cylinder 6 through the electromagnetic proportional control lifting valve 14, thereby raising the fork 5. When the fork 5 is instructed to be lowered by the lift operation lever 12, the fork 5 is lowered by a weight of the fork 5, and the hydraulic oil from the lift cylinder 6 returns to the tank 10 through the electromagnetic proportional control lifting valve 14.

The electromagnetic proportional control tilting valve controller 24 is a valve controller that controls the electromagnetic proportional control tilting valve 15 according to the operation state of the tilt operation lever 13 detected by the tilt operation detection sensor 19. Specifically, the electromagnetic proportional control tilting valve controller 24 outputs a solenoid current value according to the operation amount of the tilt operation lever 13 to the electromagnetic proportional control tilting valve 15.

Then, the mast 3 tilts. Specifically, when the mast 3 is instructed to be tilted forward or backward by the tilt operation lever 13, hydraulic oil is pumped up from the tank 10 by the hydraulic pump 9, and the hydraulic oil is supplied to the tilt cylinder 7 through the electromagnetic proportional control tilting valve 15, thereby tilting the mast 3 forward or backward.

In addition, the electromagnetic proportional control tilting valve controller 24 controls the electromagnetic proportional control tilting valve 15 such that an opening degree of the electromagnetic proportional control tilting valve 15 is limited for a certain time when an RPM of the engine 8 (hereinafter simply referred to as engine RPM) detected by the RPM sensor 20 is lower than a predetermined value (described below) at the time of tilting the mast 3 backward by the tilt cylinder 7.

The time setting unit 25 sets a period of time during which the opening degree of the electromagnetic proportional control tilting valve 15 is limited (hereinafter referred to as a time period for limiting valve opening) according to the cargo load of the cargo handling apparatus 2 detected by the pressure sensor 21 when the mast 3 is tilted backward by the tilt cylinder 7.

Figure 2:
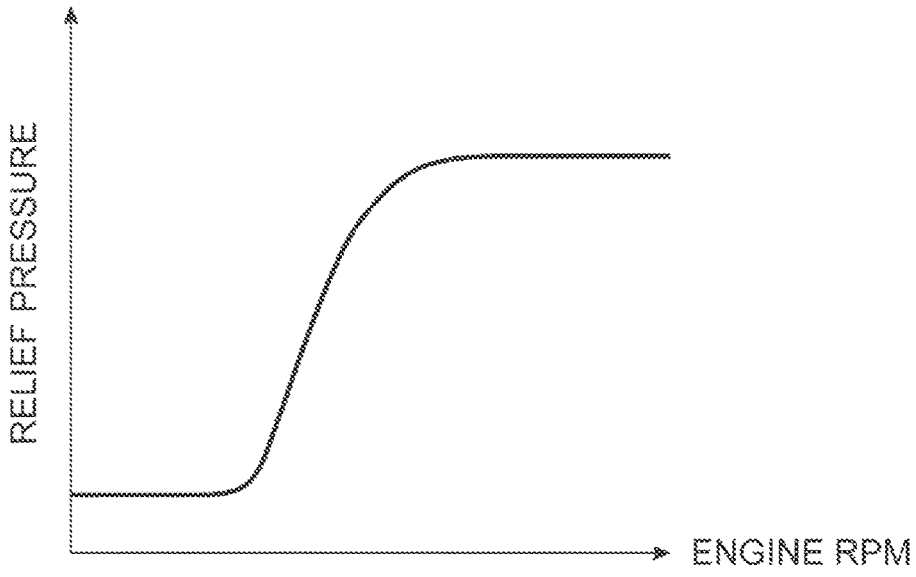
FIG. 2 is a graph illustrating a relief pressure map.

The relief pressure setting unit 26 sets a relief pressure of the electromagnetic proportional relief valve 16 according to the engine RPM detected by the RPM sensor 20, and outputs a solenoid current value corresponding to the relief pressure to the electromagnetic proportional relief valve 16. The relief pressure setting unit 26 sets the relief pressure of the electromagnetic proportional relief valve 16 using a relief pressure map illustrated in FIG. 2. The relief pressure map is a map that represents a relation between the engine RPM and the relief pressure of the electromagnetic proportional relief valve 16. The relief pressure map is determined such that the relief pressure decreases as the engine RPM decreases within a specified range of the engine RPM.

FIG. 3 is a flowchart illustrating details of a procedure executed by the main controller 22 when the mast 3 is tilted backward by the tilt cylinder 7.

In FIG. 3, first, the main controller 22 determines whether the mast 3 is instructed to be tilted backward by the tilt operation lever 13 (process S101). Upon determining that the mast 3 is instructed to be tilted backward, the main controller 22 acquires a detected value of the RPM sensor 20 (process S102).

Subsequently, the main controller 22 determines whether an engine RPM detected by the RPM sensor 20 is greater than or equal to a predetermined value (process S103). Herein, the predetermined value is an RPM at which there is a possibility that engine stall may occur by a hydraulic pressure load between the hydraulic pump 9 and the cargo handling apparatus 2, and is an idle RPM or a higher RPM than the idle RPM by a defined amount. For example, the predetermined value is an RPM within a range of 750 rpm to 1,500 rpm.

Figure 4:
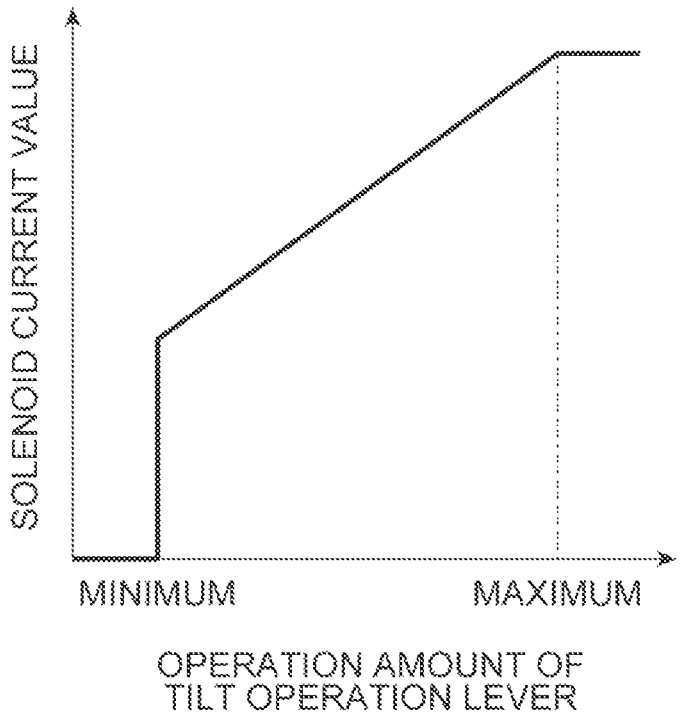
FIG. 4 is a graph illustrating a current value map.

Upon determining that the engine RPM is greater than or equal to the predetermined value, the main controller 22 obtains a solenoid current value depending on the operation amount of the tilt operation lever 13 (process S104). In this instance, the main controller 22 obtains the solenoid current value depending on the operation amount of the tilt operation lever 13 using a current value map illustrated in FIG. 4. The current value map is a map that represents a relation between the operation amount of the tilt operation lever 13 and the solenoid current value, and is determined such that the solenoid current value increases as the operation amount of the tilt operation lever 13 increases within a range in which the tilt operation lever 13 is available (within a range between a minimum operation amount and a maximum operation amount). The solenoid current value corresponds to the opening degree of the electromagnetic proportional control tilting valve 15, and the opening degree of the electromagnetic proportional control tilting valve 15 increases as the solenoid current value increases.

Figure 5A:
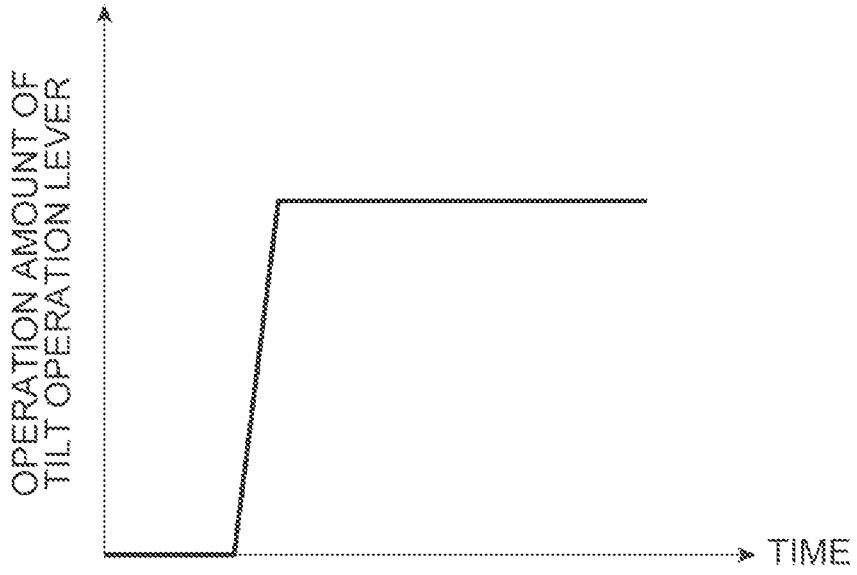
FIGS. 5A and 5B are graphs comparatively illustrating a relation between time and an operation amount of a tilt operation lever and a relation between time and a solenoid current value.
Figure 5B:
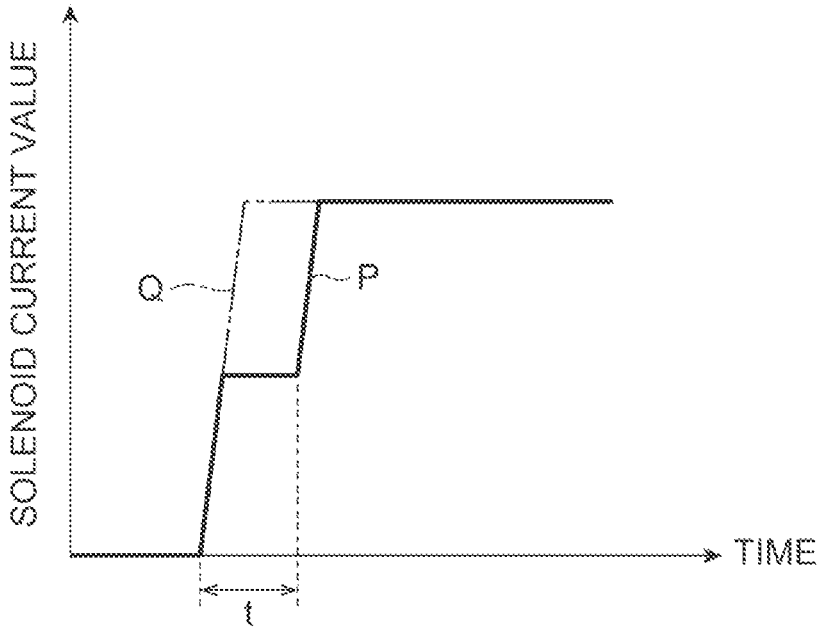

Therefore, when the tilt operation lever 13 is operated as illustrated in FIG. 5A, the solenoid current value rises according to the operation amount of the tilt operation lever 13 as indicated by an alternated long and short dash line Q of FIG. 5B.

Subsequently, the main controller 22 outputs the solenoid current value obtained in process S104 to a solenoid unit (not illustrated) of the electromagnetic proportional control tilting valve 15 (process S105). In this way, the electromagnetic proportional control tilting valve 15 is opened according to an opening degree corresponding to the solenoid current value.

When the engine RPM is determined to be lower than the predetermined value in process S103, the main controller 22 acquires a detected value of the pressure sensor 21 (process S106).

Figure 6:
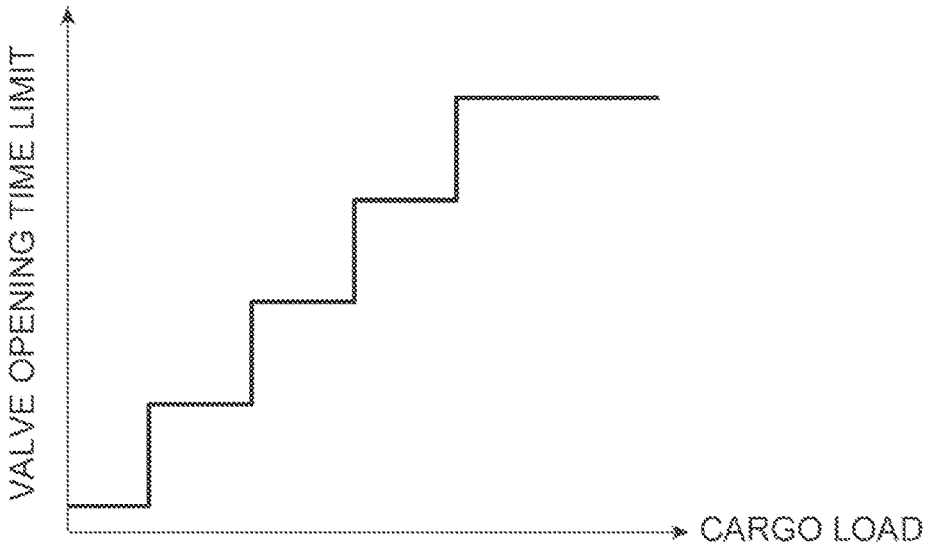
FIG. 6 is a graph illustrating a time period map for limiting valve opening.

Subsequently, the main controller 22 obtains a time period for limiting valve opening t (see FIG. 5B) depending on the cargo load of the cargo handling apparatus 2 detected by the pressure sensor 21 (process S107). In this instance, the main controller 22 obtains the time period for limiting valve opening t depending on the cargo load of the cargo handling apparatus 2 using a time period map for limiting valve opening illustrated in FIG. 6. The time period map for limiting valve opening is a map that represents a relation between the cargo load of the cargo handling apparatus 2 and the time period for limiting valve opening t, and is determined such that the time period for limiting valve opening t increases in phases as the cargo load increases.

Subsequently, the main controller 22 obtains a solenoid current value at which the opening degree of the electromagnetic proportional control tilting valve 15 is limited to a certain opening degree at a point in time at which the electromagnetic proportional control tilting valve 15 starts to be opened (process S108). In this instance, the main controller 22 obtains a solenoid current value at which the opening degree of the electromagnetic proportional control tilting valve 15 is limited to a smaller opening value than an opening degree depending on the operation amount of the tilt operation lever 13 (for example, about half the opening degree depending on the operation amount of the tilt operation lever 13) as indicated by a solid line P of FIG. 5B.

Subsequently, the main controller 22 outputs the solenoid current value obtained in process S108 to the solenoid unit (not illustrated) of the electromagnetic proportional control tilting valve 15 (process S109). In this way, the opening degree of the electromagnetic proportional control tilting valve 15 is retained at the opening degree corresponding to the solenoid current value.

Subsequently, the main controller 22 determines whether a time from when the solenoid current value starts to rise reaches the time period for limiting valve opening t (process S110). Process S110 continues until the time from when the solenoid current value starts to rise is determined to reach the time period for limiting valve opening t. In this way, the opening degree of the electromagnetic proportional control tilting valve 15 is limited to the certain opening degree during the time period for limiting valve opening t. Therefore, an operation in which the electromagnetic proportional control tilting valve 15 opens according to the opening degree depending on the operation amount of the tilt operation lever 13 is delayed.

Upon determining that the time from when the solenoid current value starts to rise reaches the time period for limiting valve opening t, the main controller 22 obtains a solenoid current value depending on the operation amount of the tilt operation lever 13 (process S111). A scheme of obtaining the solenoid current value is similar to that in process S104. Then, the solenoid current value rises depending on the operation amount of the tilt operation lever 13 as indicated by the solid line P of FIG. 5B.

Subsequently, the main controller 22 outputs the solenoid current value obtained in process S111 to the solenoid unit (not illustrated) of the electromagnetic proportional control tilting valve 15 (process S112). In this way, the electromagnetic proportional control tilting valve 15 opens according to the opening degree corresponding to the solenoid current value.

In the above description, the electromagnetic proportional control tilting valve controller 24 executes processes S101 to S105 and S108 to S112, and the time setting unit 25 executes processes S106 and S107.

Incidentally, the relief pressure of the electromagnetic proportional relief valve 16 decreases as the engine RPM decreases. Therefore, at the time of low revolution of the engine 8, the hydraulic pressure load between the hydraulic pump 9 and the cargo handling apparatus 2 is low, and thus a load input to the engine 8 is reduced. In this way, engine stall may be prevented. However, when the mast 3 is tilted backward by the tilt cylinder 7, a sliding friction and moment of a load in addition to a weight of the load are applied to the tilt cylinder 7. For this reason, at the time of starting an operation of tilting the mast 3 backward, a variation in hydraulic pressure load due to the cargo load of the cargo handling apparatus 2 easily increases. As a result, a defect in which the operation of tilting the mast 3 backward is temporarily suspended may occur according to the following flow.

(1) The operation of tilting the mast 3 backward is started.

↓

(2) The hydraulic pressure load increases.

↓

(3) The engine RPM decreases.

↓

(4) The relief pressure of the electromagnetic proportional relief valve 16 is reduced to prevent engine stall.

↓

(5) When the relief pressure of the electromagnetic proportional relief valve 16 is lower than an operating pressure of cargo handling, the operation of tilting the mast 3 backward is suspended.

↓

(6) Since the hydraulic pressure load decreases, the engine RPM rises.

↓

(7) The relief pressure of the electromagnetic proportional relief valve 16 rises.

↓

(8) When the relief pressure of the electromagnetic proportional relief valve 16 exceeds the operating pressure of cargo handling, the operation of tilting the mast 3 backward is restored.

↓

(2) The hydraulic pressure load increases.

↓

.

.

.

A phenomenon in which the operation of tilting the mast 3 backward is temporarily suspended as described above may repeatedly occur. This phenomenon easily occurs when the tilt operation lever 13 is operated, and thus the hydraulic pressure load between the hydraulic pump 9 and the cargo handling apparatus 2 sharply rises.

On the other hand, in the present embodiment, the engine RPM is detected by the RPM sensor 20, and the electromagnetic proportional control tilting valve 15 is controlled such that the opening degree of the electromagnetic proportional control tilting valve 15 is limited for the certain time when the engine RPM is lower than the predetermined value. Thus, a sharp rise in the hydraulic pressure load between the hydraulic pump 9 and the cargo handling apparatus 2 is suppressed. Therefore, the engine RPM rarely decreases, and thus the relief pressure of the electromagnetic proportional relief valve 16 rarely decreases. As a result, the relief pressure of the electromagnetic proportional relief valve 16 is prevented from being lower than the operating pressure of cargo handling, and thus the operation of tilting the mast 3 backward is prevented from being temporarily suspended.

In addition, the cargo load of the cargo handling apparatus 2 is detected by the pressure sensor 21, the time period for limiting valve opening t is set depending on the cargo load of the cargo handling apparatus 2, and the electromagnetic proportional control tilting valve 15 is controlled such that the opening degree of the electromagnetic proportional control tilting valve 15 is limited during the time period for limiting valve opening t when the engine RPM is lower than the predetermined value. Herein, the hydraulic pressure load between the hydraulic pump 9 and the cargo handling apparatus 2 increases as the cargo load of the cargo handling apparatus 2 increases. When the cargo load is light, the hydraulic pressure load is low, and temporary suspension of the operation of tilting the mast 3 backward rarely occurs. For this reason, when the cargo load is light, responsiveness of the tilt cylinder 7 of the cargo handling apparatus 2 with respect to an operation of the tilt operation lever 13 may be ensured by setting the time period for limiting valve opening t to be short. When the cargo load is heavy, the hydraulic pressure load is high, and temporary suspension of the operation of tilting the mast 3 backward easily occurs. For this reason, when the cargo load is heavy, temporary suspension of the operation of tilting the mast 3 backward may be prevented, and the load may be smoothly moved by setting the time period for limiting valve opening t to be long.

In addition, since the time period for limiting valve opening t is set in phases depending on the cargo load of the cargo handling apparatus 2, it is possible to easily set the time period for limiting valve opening t while absorbing a variation in the detected value of the pressure sensor 21.

The invention is not restricted to the above embodiment. For example, even though the time period for limiting valve opening t is set in phases depending on the cargo load of the cargo handling apparatus 2 in the above embodiment, the invention is not particularly restricted to this mode. The time period for limiting valve opening t may be continuously set depending on the cargo load of the cargo handling apparatus 2.

In addition, in the above embodiment, the time period for limiting valve opening t is set depending on the cargo load of the cargo handling apparatus 2, and the electromagnetic proportional control tilting valve 15 is controlled such that the opening degree of the electromagnetic proportional control tilting valve 15 is limited during the time period for limiting valve opening t when the engine RPM is lower than the predetermined value. However, the invention is not particularly restricted to this mode. The time period for limiting valve opening t may be fixed irrespective of the cargo load of the cargo handling apparatus 2.

In addition, in the above embodiment, the electromagnetic proportional relief valve 16, the relief pressure of which decreases as the engine RPM decreases, is used. However, a usable relief valve is not particularly restricted thereto, and may have at least two relief pressures. For example, two general relief valves having different relief pressures may be provided. Then, a relief valve having a low relief pressure may be operated when the engine RPM is low, and a relief valve having a high relief pressure may be operated when the engine RPM is high. In addition, when the phenomenon in which the operation of tilting the mast 3 backward is temporarily suspended occurs due to a factor other than an operation of the relief valve, a type of the relief valve, the number of relief valves, etc. is not particularly restricted.

Further, in the above embodiment, the electromagnetic proportional control tilting valve 15 is controlled such that the opening degree of the electromagnetic proportional control tilting valve 15 is limited for a certain time when the mast 3 is tilted backward by the tilt cylinder 7. However, the invention is not restricted to this mode. The electromagnetic proportional control lifting valve 14 may be controlled such that an opening degree of the electromagnetic proportional control lifting valve 14 is limited for a certain time when the fork 5 is raised by the lift cylinder 6. In this case, it is possible to prevent temporary suspension of an operation of raising the fork 5.

In addition, even though the cargo vehicle of the above embodiment corresponds to the forklift 1 including the fork 5, the invention is applicable to an engine-type cargo vehicle including an attachment such as a clamp, a bucket, etc. instead of the fork. In this case, it is possible to prevent temporary suspension of an operation of the attachment by controlling an electromagnetic proportional control valve for the attachment such that an opening degree of the electromagnetic proportional control valve for the attachment is limited for a certain time when the attachment is moved.

What is claimed is:

1. A cargo vehicle comprising:

a hydraulic pump driven by an engine;

a cargo handling apparatus operated by hydraulic oil from the hydraulic pump;

a cargo operating unit for performing an instruction operation to operate the cargo handling apparatus;

an electromagnetic proportional control valve disposed between the hydraulic pump and the cargo handling apparatus;

a valve controller that controls the electromagnetic proportional control valve depending on an operation state of the cargo operating unit; and a revolution detector that detects a revolution of the engine, wherein the valve controller controls the electromagnetic proportional control valve such that an opening degree of the electromagnetic proportional control valve is limited for a certain time when the revolution of the engine detected by the revolution detector is lower than a predetermined value.

2. The cargo vehicle according to claim 1, further comprising:

a cargo load detector that detects a cargo load of the cargo handling apparatus; and a time setting unit that sets a period of time during which the opening degree of the electromagnetic proportional control valve is limited depending on the cargo load of the cargo handling apparatus detected by the cargo load detector, wherein the valve controller controls the electromagnetic proportional control valve such that the opening degree of the electromagnetic proportional control valve is limited during the time period set by the time setting unit when the revolution of the engine is lower than the predetermined value.

3. The cargo vehicle according to claim 2, wherein the time setting unit sets the time period in phases depending on the cargo load of the cargo handling apparatus.

4. The cargo vehicle according to claim 1, wherein the cargo handling apparatus has a tilt cylinder that tilts a mast forward or backward, the cargo operating unit is a tilt operation unit for performing an instruction operation to operate the tilt cylinder, the electromagnetic proportional control valve is disposed between the hydraulic pump and the tilt cylinder, and the valve controller controls the electromagnetic proportional control valve such that the opening degree of the electromagnetic proportional control valve is limited for a certain time when the revolution of the engine is lower than the predetermined value at a time of performing an instruction operation by the tilt operation unit to tilt the mast backward.

* * * * *